US007573436B2

(12) United States Patent
Webb et al.

(10) Patent No.: US 7,573,436 B2
(45) Date of Patent: Aug. 11, 2009

(54) COMPACT RADIO FREQUENCY TRANSMITTING AND RECEIVING ANTENNA AND CONTROL DEVICE EMPLOYING SAME

(75) Inventors: Spencer L. Webb, Pelham, NH (US); Stephen S. Thompson, London (GB); Gregory S. Altonen, Easton, PA (US); Stuart DeJonge, Riegelsville, PA (US); Edward M. Felegy, Jr., Macungie, PA (US); Siddharth P. Sinha, London (GB)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

(21) Appl. No.: 11/874,642

(22) Filed: Oct. 18, 2007

(65) Prior Publication Data

US 2008/0036679 A1 Feb. 14, 2008

Related U.S. Application Data

(62) Division of application No. 10/873,033, filed on Jun. 21, 2004, now Pat. No. 7,362,285.

(51) Int. Cl.
*H01Q 7/00* (2006.01)

(52) U.S. Cl. ..... 343/866; 343/867

(58) Field of Classification Search ..... None
See application file for complete search history.

(56) References Cited

U.S. PATENT DOCUMENTS 3,049,711 A 8/1962 Hopper
3,550,137 A 12/1970 Kuecken
3,588,905 A 6/1971 Dunlavey
4,864,588 A 9/1989 Simpson et al.
4,932,037 A 6/1990 Simpson et al.

(Continued)

FOREIGN PATENT DOCUMENTS

DE 88 00 025 U1 4/1988

(Continued)

*Primary Examiner*—Trinh V Dinh
(74) *Attorney, Agent, or Firm*—Ostrolenk, Faber, Gerb & Soffen, LLP

(57) ABSTRACT

An electrical control device for controlling the status of a controlled electrical device, the electrical control device comprising a power conducting semiconductor device for controlling the status of the controlled electrical device; a control circuit; a transmitter and/or receiver in communication with the control circuit; and an antenna coupled to the transmitter and/or receiver; the antenna adapted to receive a first signal at a specified frequency from a remote control device and/or transmit a second signal at a specified frequency to a remote control device; wherein the transmitter is operable to couple the first signal from the antenna to the control circuit for remotely controlling the controllably conductive device and/or couple the second signal from the control circuit for providing a status of said controlled electrical device, the antenna comprising a first loop of conductive material having a capacitance and an inductance; the capacitance and the inductance forming a circuit being resonant at the specified frequency; a second loop of conductive material having two ends adapted to be electrically coupled to a control circuit, the second loop being substantially only magnetically coupled to the first loop; the first and second loops each having a loop axis, the loop axes of the first and second loops being substantially parallel or coincident.

14 Claims, 13 Drawing Sheets

U.S. PATENT DOCUMENTS

| | | | | |
|---|---|---|---|---|
| 4,995,053 | A | 2/1991 | Simpson et al. | |
| 5,225,847 | A | 7/1993 | Roberts et al. | |
| 5,239,205 | A | 8/1993 | Hoffman et al. | |
| 5,340,954 | A | 8/1994 | Hoffman et al. | |
| 5,736,965 | A | 4/1998 | Mosebrook et al. | |
| 5,818,128 | A | 10/1998 | Hoffman et al. | |
| 5,838,226 | A | 11/1998 | Houggy et al. | |
| 5,848,054 | A | 12/1998 | Mosebrook et al. | |
| 5,905,442 | A | 5/1999 | Mosebrook et al. | |
| 5,982,103 | A | 11/1999 | Mosebrook et al. | |
| 6,144,346 | A | 11/2000 | Boy | |
| 6,236,368 | B1 | 5/2001 | Johson | |
| 6,687,487 | B1 | 2/2004 | Mosebrook et al. | |
| 6,803,728 | B2 | 10/2004 | Balasubramaniam et al. | |
| 6,909,401 | B2 * | 6/2005 | Rutfors et al. | 343/702 |
| 7,000,837 | B2 | 2/2006 | Akiho et al. | |
| 7,106,261 | B2 | 9/2006 | Nagel et al. | |
| 7,183,987 | B2 * | 2/2007 | Akiho et al. | 343/742 |
| 2005/0040997 | A1 | 2/2005 | Akiho et al. | |
| 2005/0057422 | A1 | 3/2005 | Deguchi et al. | |
| 2006/0028384 | A1 | 2/2006 | Akiho et al. | |

FOREIGN PATENT DOCUMENTS

| | | |
|---|---|---|
| WO | WO 02/25583 | 3/2002 |
| WO | WO 02/071536 | 9/2002 |
| WO | WO 03/096478 | 11/2003 |

* cited by examiner

COMPACT RADIO FREQUENCY TRANSMITTING AND RECEIVING ANTENNA AND CONTROL DEVICE EMPLOYING SAME

CROSS-REFERENCE TO RELATED APPLICATION

This is a divisional of U.S. patent application Ser. No. 10/873,033, filed Jun. 21, 2004 entitled COMPACT RADIO FREQUENCY TRANSMITTING AND RECEIVING ANTENNA AND CONTROL DEVICE EMPLOYING SAME, the disclosure of which is hereby incorporated by reference.

BACKGROUND OF THE INVENTION

The present invention relates to antennas and in particular, to radio frequency antennas for transmitting and receiving radio frequency (RF) signals. Even more particularly, the present invention relates to a compact antenna, which is provided for use in connection with a radio frequency controlled lighting control system. In particular, the present invention relates to an antenna which is provided on a lighting control device, for example, a light dimmer, and which receives and/or transmits radio frequency signals for controlling a lamp and communicating status of the lamp, for example, on, off, and intensity level. The radio frequency signals are used to control from a remote master location the status of the lamp connected to the light dimmer and also to provide information back to the master location concerning the status of the controlled lamp. The device at the master location may also employ an antenna according to the invention.

The invention also relates to a control device employing the antenna that can be mounted in a standard electrical wall box. In particular, the invention relates to a local electrical control device capable of remotely controlling one or more electric lamps and adapted to be mounted in a standard electrical wall box and receiving and transmitting signals via the antenna. The invention further relates to a master control device capable of remotely controlling one or more local electrical control devices and adapted to be mounted in a standard electrical wall box and employing the antenna to transmit to and receive signals from a local electrical control device which responds to the control signals from the master device.

Although the present invention is directed to an antenna for use in a lighting control system, the antenna of the present invention can be applied to the communication of signals relating to the control and status of other devices, for example, communication equipment, motors, security systems, appliances, HVAC systems (heating, ventilating, and air conditioning) and other devices.

The present invention is directed to an antenna of compact design which can be included within the lighting control device, for example a light dimmer, and which fits into a standard electrical wall box. The invention is also directed to a lighting control device itself, either a master or local (remote) unit. The invention is of particular use in a system which uses radio frequency signals to control the status of controlled electrical devices such as electric lamps. In such a system, the conventional manually controlled hard wired lighting control devices, for example, wall switches and dimmers, are replaced by control devices having a control circuit and an antenna according to the present invention. The system in which the antenna according to the present invention is used may thus be provided to enable an existing building lighting system (or other electrical/electronic devices) to be controlled remotely from various locations without requiring hard wiring of the building to incorporate the necessary control wiring to accomplish remote control of lighting fixtures or other devices. Accordingly, in a system in which the antenna of the present invention is used, the lighting control device, for example, a light dimmer which replaces the conventional light switch/dimmer, contains an antenna according to the present invention, the necessary actuators for accomplishing manual control of the lighting fixture, as well as a control circuit and RF circuit for allowing remote control via signals received and transmitted by the antenna of the lighting control device. The antenna and control device fit within a standard electrical wall box allowing the conventional lighting control device to be removed and replaced by the lighting control device according to the invention. Similarly, a master unit according to the invention having actuators thereon and an antenna for transmitting signals to the local control devices and receiving status signals from the local control device is also adapted according to one embodiment of the invention, to be disposed in a conventional electrical wall box.

In accordance with the present invention, the antenna is of compact size such that it fits within the standard electric wall box together with the control device electronic circuitry and mechanical components and is a part of the electrical control device for controlling the lamp.

In addition, although the control device employing the antenna of the present invention has been described in connection with its use in replacing conventional, non-radio frequency controlled lighting control devices, the present invention can also be employed in new construction so that the number of wires that need to be routed in the new construction can be reduced. Accordingly, in the system employing the present invention, it is not necessary to run control wires (only the electrical power wires need to be installed) to control the lighting system since the antenna of the present invention will and receive transmit radio frequency signals to accomplish this control.

There is presently a system known in the prior art that allows for remote control of lamps without hard wiring the control wires to the lighting control devices. This known system is the Lutron Radio RA system in which lamps are controlled remotely by radio frequency signals. In the Radio RA system, each lighting control device, in addition to manual controls, has a transceiver and an antenna, which receives and transmits radio frequency signals from and to a master control unit. At the master control unit, the status of the various lamps in the building structure can be remotely controlled, that is, the on, off and intensity level status can be controlled from the master control unit by sending RF signals from the master device to the lighting control devices. In order to ensure that radio frequency signals are transmitted to and from all devices in the system, repeaters are employed as necessary. Patents describing the Radio RA System include U.S. Pat. Nos. 5,905,442 and 5,848,054, among others.

In the existing Radio RA system, a compact radio antenna is used which comprises a planar antenna. That planar antenna, although satisfactory, has a number of disadvantages. One of the problems with the prior art antenna is that it is relatively expensive to make, requiring inductive patterns disposed on the printed circuit board determining the frequency of resonance. These planar antennas are somewhat expensive to manufacture. In addition, the antenna of the prior art device is relatively large in size, being substantially coextensive with the electrical box opening. Further, it is desirable to increase the transmission range of the antenna of the prior art device. Furthermore, the prior art device requires substantial insulation because the antenna is connected to the AC line (or "line voltage") and is thus at the same electrical potential. Line voltage is approximately 120 $V_{RMS}$ in the United States, for example, and varies throughout the countries and regions of the world. Accordingly, to provide user protection from electrical shock, the planar antenna of the prior art device requires substantial insulation members. Because the planar antenna is relatively large and because it is electrically connected to the line voltage of the dimmer, more insulation is needed when using the planar antenna, thus increasing the cost of the dimmer. The antenna of the prior art device is described in U.S. Pat. Nos. 5,982,103 and 5,736,965.

It is thus desirable to provide an antenna, which offers increased performance characteristics, requires less insulation or is isolated from the AC line, and is smaller and less expensive to make.

SUMMARY OF THE INVENTION

It is accordingly, an object of the present invention to provide an antenna for an RF communication system for controlling lamps and other electrical devices, and in which the antenna forms an integral part of a control device (e.g., a lighting control device), which can be completely installed in a conventional electrical box.

It is a further object of the present invention to provide such an antenna, which is not visible, being completely contained within the lighting control device in the conventional electrical box.

It is a further object of the present invention to provide an antenna as part of a lighting control device which is less expensive to make than the prior art planar antenna and which is smaller in size than the prior art planar antenna.

Yet still a further object of the present invention is to provide an antenna for a lighting control device whose radiating part is isolated from the AC line, thereby reducing the amount of insulation necessary to protect the user.

It is yet still a further object of the present invention to provide an antenna of compact design that provides a substantially isotropic radiation pattern, that is, a radiation pattern that is substantially the same at a defined distance from the antenna.

It is yet still a further object of the present invention to provide an antenna that is easily tunable, has a broader potential frequency range and is made from readily available materials.

It is yet still a further object of the present invention to provide such an antenna that has flexibility so that it is useful in different products and, in particular, useful in different control units of an RF lighting control system, for example, master unit, repeater and local lighting control unit.

It is yet still a further object of the present invention to provide an antenna which is sufficiently small to fit into confined spaces, and, in particular, to serve as an integral part of a lighting control device such as a lamp dimmer installed in a standard electrical wall box.

It is yet still a further object of the present invention to provide an antenna which has an increased transmission range over the prior art compact antennas used in remote control lighting control devices.

The objects of the invention are achieved by a compact antenna for transmitting or receiving radio frequency signals at a specified frequency comprising a first loop of conductive material having at least one break in said loop and a capacitance including a capacitor bridging the break, the loop having an inductance and forming a circuit with the capacitance, the circuit comprising the loop and the capacitance being resonant at the specified frequency, and a second loop of conductive material having two ends adapted to be electrically coupled to an electronic circuit, the second loop being substantially only magnetically (or inductively) coupled to the first loop, the first and second loops having loop axes that are substantially parallel or coincidental.

In a first embodiment, the first and second loops are formed by metallic layers on printed circuit boards, with the first loop being disposed on two opposite surfaces of a first printed circuit board, the first printed circuit board being disposed on a yoke of an electrical control device for mounting the electrical control device to an electrical box. The metallic surface on the outermost surface of the printed circuit board operates as the radiation element.

In another embodiment, the first loop comprises a metal lance preferably stamped from the yoke of the lighting control device and having a capacitance disposed between a portion of the lance and the yoke, thereby forming an electrical current loop comprising the lance, capacitance and a portion of the yoke adjacent the lance. The lance operates as a radiation element.

The objects of the invention are also achieved by a compact antenna for transmitting or receiving radio frequency signals at a specified frequency comprising a first loop of conductive material having at least one break in said loop and a capacitance including a capacitor bridging the break, the loop having an inductance and forming a circuit with the capacitance, the circuit comprising the loop and the capacitance being resonant at the specified frequency, and a second loop of conductive material having two ends adapted to be electrically coupled to an electronic circuit, the second loop being substantially only magnetically coupled to the first loop, the antenna comprising a part of an electrical control device, the electrical control device having a mounting yoke disposed in a plane, the first loop having a loop axis that is substantially parallel to or coincidental with the plane of the yoke.

The objects of the invention are also achieved by a compact antenna for transmitting or receiving radio frequency signals at a specified frequency comprising a first printed circuit board comprising a first loop of conductive material having at least one break in said loop and a capacitance including a capacitor bridging the break, the loop having an inductance and forming a circuit with the capacitance, the circuit comprising the loop and the capacitance being resonant at the specified frequency; and a second printed circuit board comprising a second loop of conductive material having two ends adapted to be electrically coupled to an electronic circuit, the second loop being substantially only magnetically coupled to said first loop of said first printed circuit board.

The objects of the invention are also achieved by an electrical control device adapted to be mounted at least partly within an electrical wall box for controlling the status of a controlled electrical device, the electrical control device comprising a housing, a support yoke coupled to the housing, the support yoke having a fastening device for coupling the yoke to the electrical wall box, a controllably conductive device contained within the housing for controlling the status of the controlled electrical device, a control circuit contained in the housing, a transmitter and/or receiver contained in the housing, and an antenna adapted to receive a signal at a specified frequency from a remote control device and/or transmit a signal at a specified frequency to a remote control device, the antenna being coupled to the transmitter and/or receiver, the transmitter and/or receiver of coupling a signal from the remote control device to said control circuit for remotely controlling said controllably conductive device, and/or receiving a signal from said control circuit for providing a signal to said remote control device to indicate the status of said controlled electrical device, the antenna comprising a first loop of conductive material having at least one break in said loop and a capacitance including a capacitor bridging the break, the loop having an inductance and forming a circuit with the capacitance, the circuit comprising the loop and the capacitance being resonant at the specified frequency, a second loop of conductive material having two ends adapted to be electrically coupled to a control circuit, the second loop being substantially only magnetically coupled to said first loop, said first and second loops each having a loop axis, the loop axes of the first and second loops being substantially parallel or coincidental.

The objects of the invention are also achieved by a remote control device adapted to be mounted at least partly within an electrical wall box, and adapted to control without a wire connection, an electrical control device connected to a controlled electrical device, the remote control device comprising a housing, a support yoke coupled to the housing, the support yoke having a fastening device for coupling the yoke to the electrical wall box, a control circuit contained in the housing, a transmitter and/or receiver contained in the housing, an antenna, at least one actuator coupled to said control circuit to provide a signal thereto to control the status of the controlled electrical device, said antenna adapted to transmit a signal at a specified frequency from the control circuit to said electrical control device, and/or receive a signal at the specified frequency from said electrical control device, the antenna being coupled to a transmitter and/or receiver, the transmitter and/or receiver of coupling said signal from said control circuit to the antenna for remotely controlling the electrical control device thereby to control the status of the controlled electrical device, and/or receiving said signal from said antenna from the electrical control device for providing a signal to said control circuit to indicate the status of said controlled electrical device, the antenna comprising a first loop of conductive material having at least one break in said loop and a capacitance including a capacitor bridging the break, the loop having an inductance and forming a circuit with the capacitance, the circuit comprising the loop and the capacitance being resonant at the specified frequency, a second loop of conductive material having two ends adapted to be electrically coupled to the control circuit, the second loop being substantially only magnetically coupled to said first loop, and said first and second loops each having a loop axis, the loop axes of the first and second loops being substantially parallel or coincidental.

The objects of the invention are also achieved by an electrical control device adapted to be mounted at least partly within an electrical wall box for controlling the status of a controlled electrical device, the electrical control device comprising a housing, a support yoke coupled to the housing, the support yoke being disposed in a plane and having a fastening device for coupling the yoke to the electrical wall box, a controllably conductive device contained within the housing for controlling the status of the controlled electrical device, a control circuit contained in the housing, a transmitter and/or receiver contained in the housing, and an antenna adapted to receive a signal at a specified frequency from a remote control device and/or transmit a signal at a specified frequency to a remote control device, the antenna being coupled to the transmitter and/or receiver, the transmitter and/or receiver of coupling a signal from the remote control device to said control circuit for remotely controlling said controllably conductive device, and/or receiving a signal from said control circuit for providing a signal to said remote control device to indicate the status of said controlled electrical device, the antenna comprising a first loop of conductive material having at least one break in said loop and a capacitance including a capacitor bridging the break, the loop having an inductance and forming a circuit with the capacitance, the circuit comprising the loop and the capacitance being resonant at the specified frequency, a second loop of conductive material having two ends adapted to be electrically coupled to a control circuit, the second loop being substantially only magnetically coupled to said first loop, said first loop having a main loop axis substantially parallel to the plane of the yoke.

The objects of the invention are also achieved by a remote control device adapted to be mounted at least partly within an electrical wall box, and adapted to control without a wire connection, an electrical control device connected to a controlled electrical device, the remote control device comprising a housing, a support yoke coupled to the housing, the support yoke being disposed in a plane and having a fastening device for coupling the yoke to the electrical wall box, a control circuit contained in the housing, a transmitter and/or receiver contained in the housing, an antenna, at least one actuator coupled to said control circuit to provide a signal thereto to control the status of the controlled electrical device, said antenna adapted to of transmit a signal at a specified frequency from the control circuit to said electrical control device, and/or receive a signal at the specified frequency from said electrical control device, the antenna being coupled to a transmitter and/or receiver, the transmitter and/or receiver of coupling said signal from said control circuit to the antenna for remotely controlling the electrical control device thereby to control the status of the controlled electrical device, and/or receiving said signal from said antenna from the electrical control device for providing a signal to said control circuit to indicate the status of said controlled electrical device, the antenna comprising a first loop of conductive material having at least one break in said loop and a capacitance including a capacitor bridging the break, the loop having an inductance and forming a circuit with the capacitance, the circuit comprising the loop and the capacitance being resonant at the specified frequency, a second loop of conductive material having two ends adapted to be electrically coupled to the control circuit, the second loop being substantially only magnetically coupled to said first loop, and said first loop having a main loop axis substantially parallel to the plane of the yoke.

Other features and advantages of the present invention will become apparent from the following description of the invention which refers to the accompanying drawings.

BRIEF DESCRIPTION OF THE DRAWINGS

The invention will now be described in greater detail in the following detailed description with reference to the drawings in which.

Other objects features and advantages of the present invention will become apparent from the detailed description, which follows.

DETAILED DESCRIPTION OF THE INVENTION

Figure 1:
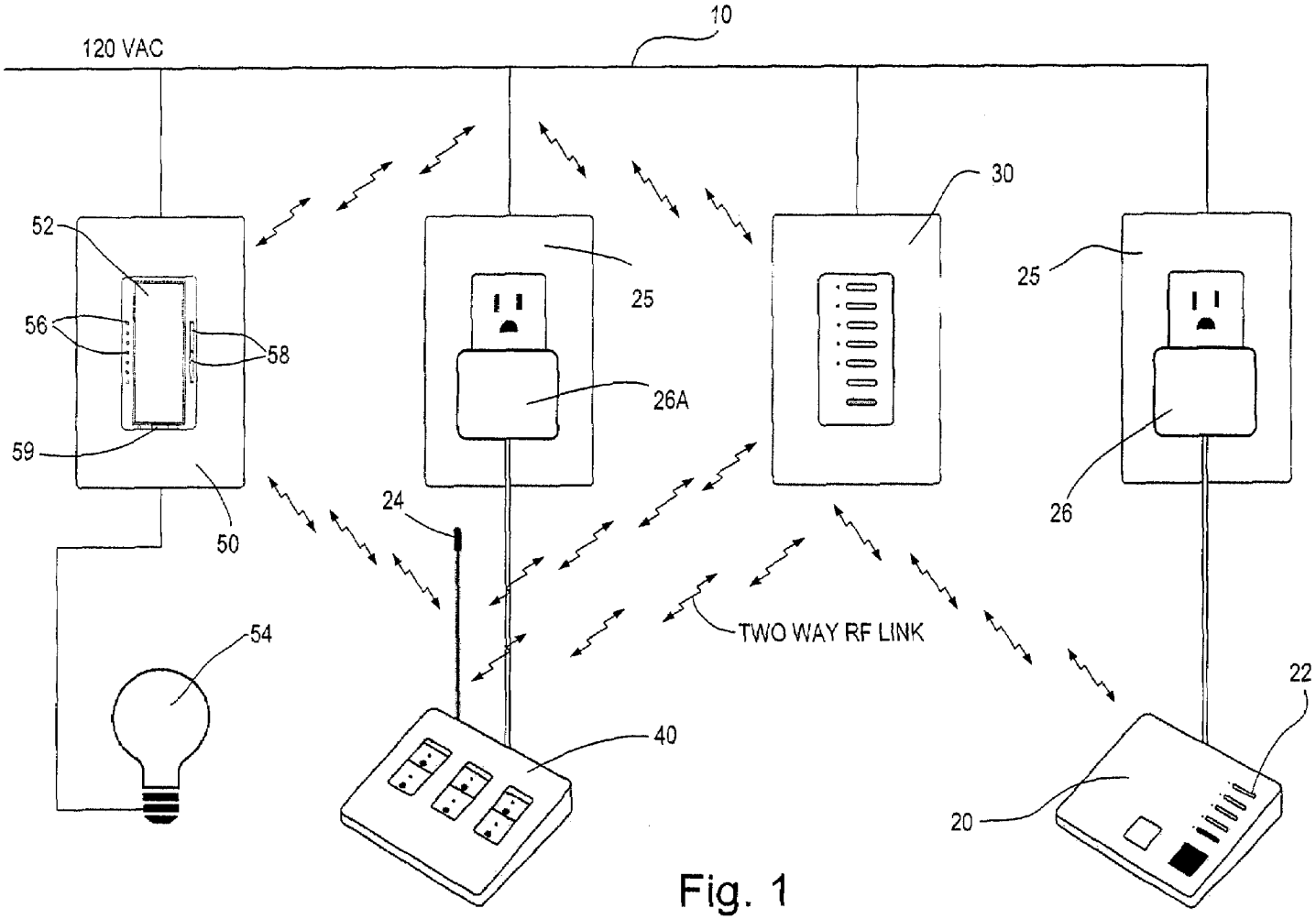
FIG. 1 shows a block diagram of a radio frequency controlled lighting system making use of the antenna according to the present invention.

With reference now to the drawings, the antenna and control unit according to the present invention comprise components of a radio frequency controlled lighting control system. Such a system is connected into the building hardwired electrical power system 10, shown in FIG. 1. Only the hot side of the AC circuit is shown in FIG. 1. The neutral and ground lines are not shown. With the exception of installing lighting control devices to replace the existing standard lighting control switches and dimmers, however, no change in the building wiring is necessary to implement the control functions. Accordingly, the system shown in FIG. 1 can be used to provide remote control of a building lighting system without installing any additional wires. This is particularly useful to retrofit an existing building for remote control without expensive construction work and rewiring. However, systems of this type can also be employed in new construction to reduce the amount of wiring necessary. All control functions are accomplished by radio frequency signals transmitted between master and lighting control devices, lighting control devices and repeaters, and masters and repeaters, as appropriate.

According to such a system, a master control device 20 may be installed having a plurality of controls and status indicators 22 which control various lamps assigned to the various control actuators. The assignment of the particular lamps to particular control buttons can be in accordance with the previously known Lutron Radio RA system. That system is described, for example, in U.S. Pat. Nos. 5,905,442 and 5,848,054, among others, the entire disclosures of which are incorporated by reference herein. The master device 20 includes an internal antenna, which is hidden from view (or an external antenna) and receives and transmits radio frequency signals for control and status functions. The master device 20 plugs into a wall outlet 25 for power via an AC transformer 26. If desired, additional master devices 20 can be provided. A wall mounted master unit or units 30 can also be provided. The master unit 30 is identified as a wall-mount master because it is installed into an existing electrical wall box. The wall mount master 30 may also include an internal antenna according to the inventions, which is hidden from view. Any number of master units, either of the table top type 20 or all wall-mount type 30 can be provided in the system.

According to the system described, a repeater (or repeaters) 40 may also be provided to ensure that every component of the system will receive the RF communication signal for control purposes. The repeater 40 includes an external antenna 24 (or a hidden antenna) for transmitting and receiving radio frequency signals. The repeater may be powered by a transformer 26A plugged into wall outlet 25. The repeater is described in the above-identified patents. Note that repeater 40 and master device 20 could be battery powered rather than via AC transformer 26.

At least one lighting control device 50 is provided which includes an antenna according to the present invention. The lighting control device 50 is capable of manual actuation via a manual control button 52, but which is also capable of receiving radio frequency signals from the master units 20, 30 or repeater 40 to control the status of a lamp 54. In addition, the lighting control device 50 is preferably capable of transmitting radio frequency signals to the repeater 40 and master units 20 and 30 to inform the master units of the status of the affected lamp or lamps 54. The lighting control device 50 may comprise a dimmer, for example, and may include a plurality of status indicating devices, for example, light emitting diodes (LEDs) and/or optical fibers 56, which indicate the intensity and setting of the lamp 54 to the user. The indicators 56 may be direct view LEDs or fiber optic pipes, which receive light energy from suitable illumination devices such as light emitting diodes. In addition, the lighting control device 50 includes a means 58 for setting the intensity level, for example, such means 58 may comprise an up/down rocker switch. Furthermore, an on/off switch 59 may be provided to disable the operation of the lamp. The on/off switch 59 may comprise an air gap switch that completely isolates the lamp from the dimmer circuit, for example, when performing lamp maintenance. A plurality of lighting control devices 50 controlling respective lamps 54 can be provided according to the system described. While dimmer 50 and master 30 are described here as having the antenna according to the present invention, the master unit 20 and repeater 40 could also have such an antenna.

Figure 2:
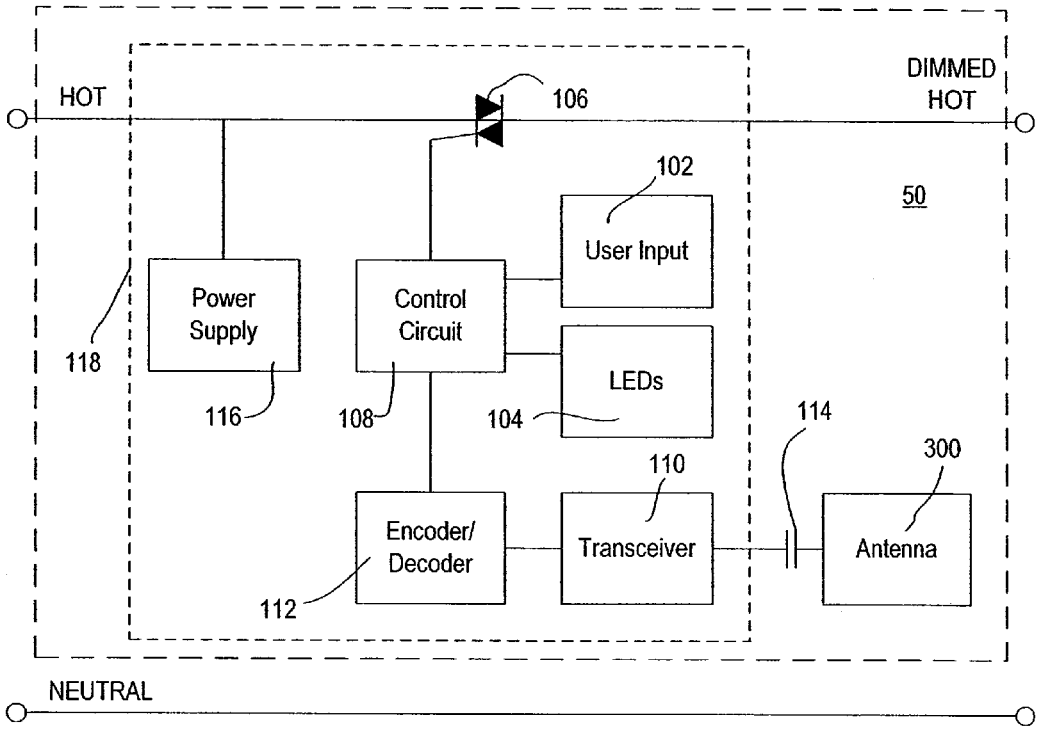
FIG. 2 shows a simplified block diagram of a lighting control device, such as a dimmer, which is adapted to both receive control signals for controlling a lamp load as well as transmit status signals concerning the status of the lamp load.

FIG. 2 shows a simplified block diagram of the lighting control device 50, which is capable of both receiving and transmitting RF signals. The HOT terminal of the lighting control device 50 is connected to an electrical power system 10 and the DIMMED HOT terminal is connected to the lamp load 54. The neutral line connected to the lamp load 54 need not be connected to the lighting control device 50. In this way, the lighting control device 50 can replace a simple two-wire on/off switch or dimmer.

Figure 3:
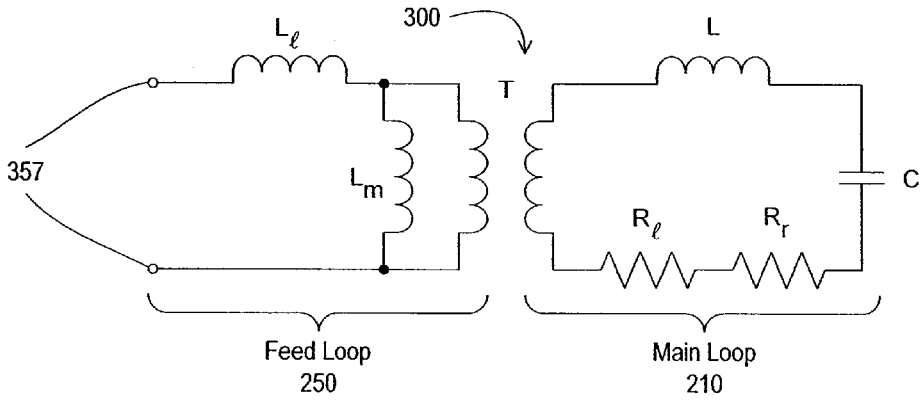
FIG. 3 shows an equivalent circuit for the antenna according to the present invention.

This lighting control device 50 has a user input means 102, which may comprise suitable switches or controls for providing on/off and dimming functions. A triac 106 (or other suitable power conducting semiconductor) controls the amount of power delivered to the lamp load 54 as determined by a control circuit 108. The antenna of the present invention 300 is connected to a transceiver 110 via a DC (direct current) blocking capacitor 114 to eliminate DC current in the antenna. The transceiver 110 is also coupled to an encoder/decoder 112, which is coupled to the control circuit 108. The transceiver 110 is capable of both transmitting RF signals to the antenna 300 for transmission and for receiving RF signals for controlling the control circuit 108. A power supply 116 provides power to the control and other circuits of the dimmer 50. For example, the power supply 116 may be a "cat-ear" power supply, which obtains power only during those portions of a cycle when the triac 106 is off, thereby preventing voltage drops to the lamp load 54. The user input 102, triac 106, control circuit 108, transceiver 110, encoder/decoder 112, and power supply 116 are all mounted on a dimmer circuit printed circuit board (PCB) 118. FIG. 3 shows an equivalent circuit of the antenna 300 according to the present invention. The antenna 300 is comprised of two parts: a main loop 210 and a feed loop 250. The main loop 210 is the primary radiating element of the antenna 300 and includes an inductance L and capacitance C in series. When energized, the main loop 210 resonates at a frequency determined by the values. of L and C and enables the transmitting and receiving of RF signals via a radiation resistance, $R_r$, which is a representation of the energy delivered to radiation. The losses in the main loop 210 are represented by a loss resistance, $R_l$. The main loop 210 is primarily magnetically coupled to the feed loop 250. This coupling is shown schematically in FIG. 3 by an ideal transformer T. The feed loop 250 includes a magnetizing inductance $L_m$, a leakage inductance $L_l$, and two ends 357 that connect to the dimmer circuit PCB 118 via capacitor 114. The feed loop 250 allows for the conduction of signals between the dimmer circuit PCB 118 and the main loop 210. In this way, the antenna 300 is adapted to receive signals via the main loop 210, with those radio frequency signals being electromagnetically coupled to the feed loop 250 for input to the RF circuit transceiver 110. Conversely, the feed loop 250 receives signals to be transmitted from the transceiver 110, electromagnetically couples these signals to the main loop 210 for transmission of RF signals to a master or repeater device.

Figure 4:
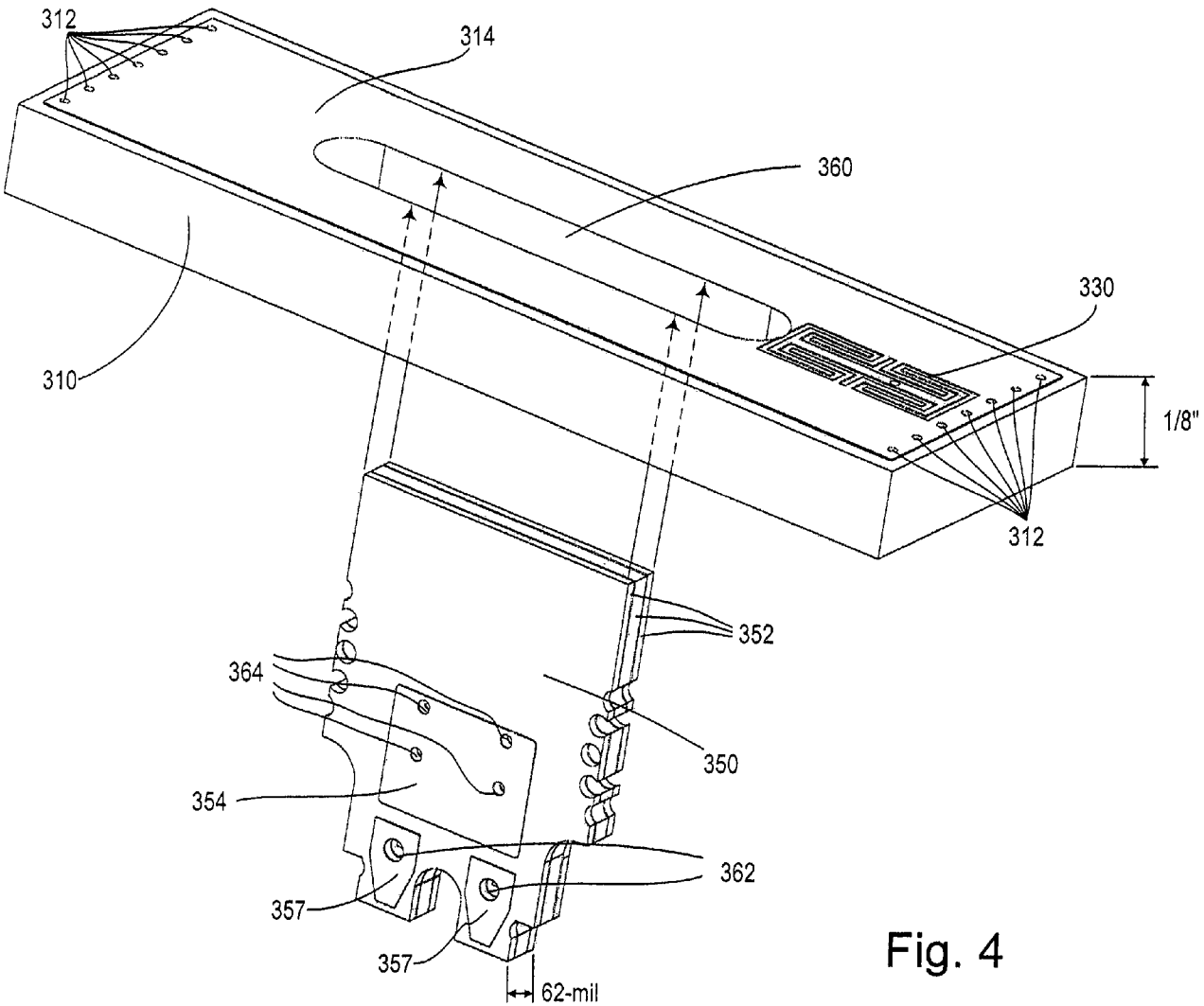
FIG. 4 is an exploded simplified schematic perspective view of the first embodiment of the antenna according to the present invention.

FIG. 4 shows a perspective simplified schematic exploded view of this embodiment of the antenna 300 of the present invention. According to the present invention, the antenna 300 comprises a resonant loop antenna comprising a main loop printed circuit board (PCB) 310, which preferably comprises a printed circuit board, preferably ⅛ inch thickness FR4 printed circuit substrate, on which is deposited a conductive material 314, e.g., copper, aluminum or steel, on both upper and lower sides. The conductive material 314 on the upper and lower sides are connected by vias 312 provided to form a loop for current flow between the upper and lower sides of the main loop PCB. The main loop PCB 310 has an inherent inductance that supplies the inductance L as shown in FIG. 3. The main loop PCB 310 also includes a slot 360, sized to allow the feed loop printed circuit board (PCB) 350 to fit within the slot in a perpendicular orientation to the main loop PCB. The feed loop PCB 350 may comprise a 62-mil thickness FR4 printed circuit board having two ends 357 adapted for connection to the dimmer circuit PCB 118 of the lighting control device 50.

Figure 5A:
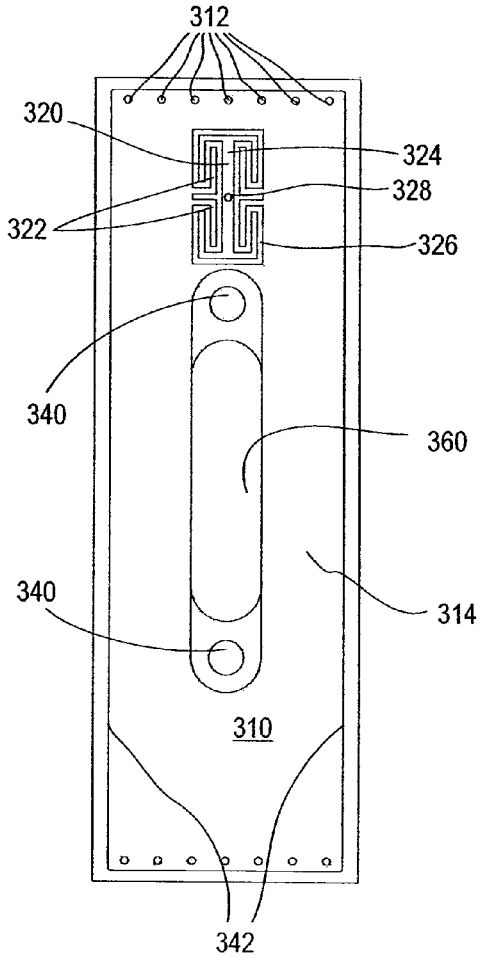
FIGS. 5*a* and 5*b* show a top and bottom view, respectively, of a first embodiment of the main loop printed circuit board.
Figure 5B:
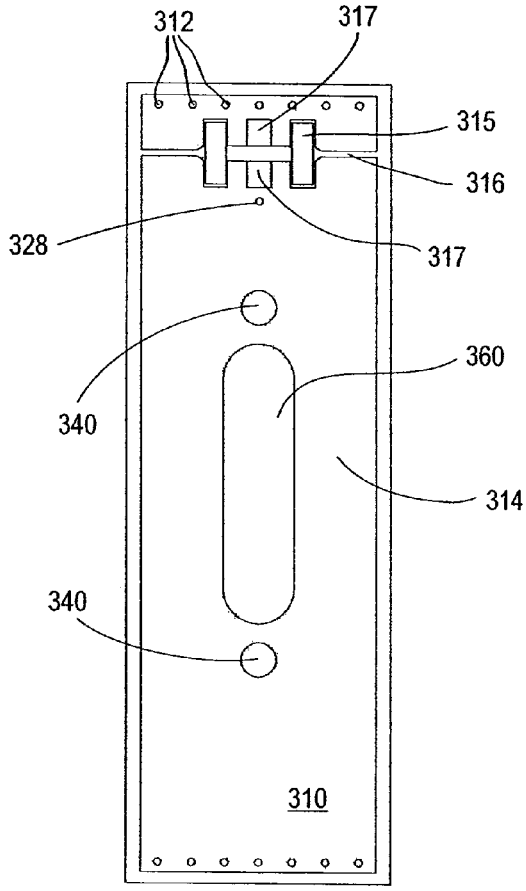

A top view and a bottom view of the main loop PCB 310 are shown in FIGS. 5*a* and 5*b*, respectively. One of the layers of conductive material 314, e.g., on the bottom side of the main loop PCB 310, is provided with a break or slot 316. Across the slot, suitable surface mount capacitors 315 may be disposed to provide, along with an inherent capacitance of the main loop PCB, the capacitance C as shown in FIG. 3. The capacitors may comprise, for example, surface mount capacitors, which can be trimmed (using a trimmable capacitor) to adjust the resonant frequency of the main loop. The capacitors thereby form, with the printed circuit, an LC circuit. The current in the LC circuit is at a maximum magnitude when the RF signal being transmitted or received is at the resonant frequency determined by the inductance L and capacitance C of the main loop PCB 310.

Apertures 340 in the main loop PCB 310 allow for attachment of the main loop PCB with the dimmer 50 by a heat stake, which is an insulating fastener that does not change the magnetic characteristics of the main loop PCB. The heat stake is made from a thermoplastic material and comprises two straight posts that fit through apertures 340 in the main loop PCB 310. The ends of the posts are formed by the use a horn, which is heated in order to melt the thermoplastic material. After the heat staking process, the ends of the posts have a diameter greater than the diameter of the apertures 340, thus holding the main loop PCB 310 in place. Alternatively, other means of forming the ends of the posts may be used, such as ultrasonic staking, in which the ends are heated and formed by vibration of the horn. This design allows for attachment of the main loop PCB 310 at areas of minimal current density. It has been determined that the areas of maximum current density are at the edges 342 of the main loop PCB 310 so that in this embodiment, there is less interference with the current flow in the main loop. However, other means such as snap connections at the edges of the main loop PCB 310, may be used.

The top side of the main loop PCB 310 is provided with interdigitated fingers 320 that provide means for trimming the inherent capacitance of the LC circuit forming the resonant main loop. The outer fingers 322 and the inner fingers 334 are separated from each other by a break 326. The inner fingers 324 are coupled to the conductive material 314 on the bottom side of the main loop PCB 310 by via 328. The fingers are trimmed by cutting away the copper using a laser or other means of cutting. Trimming the inner fingers 324 produces a greater change in the capacitance of the main loop PCB 310 than trimming the outer fingers 322.

Figure 5C:
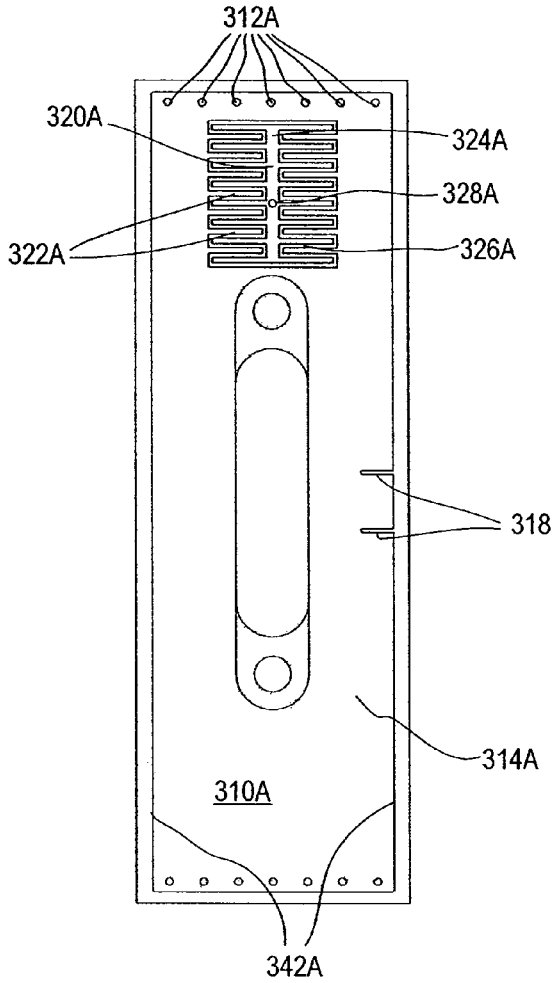
FIGS. 5*c* and 5*d* show a top and bottom view, respectively, of a second embodiment of the main loop printed circuit board.
Figure 5D:
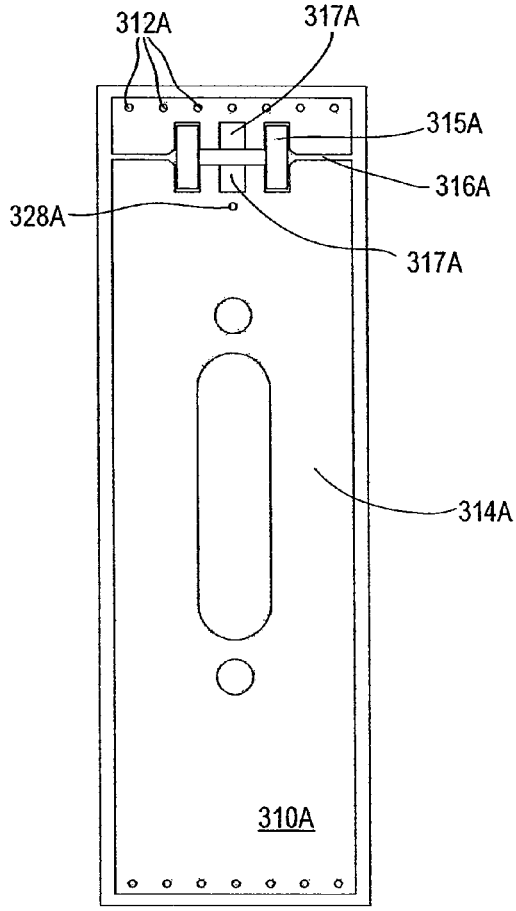

FIGS. 5*c* and 5*d* show the top view and bottom view, respectively, of a second possible embodiment of the main loop PCB 310A. A different configuration of interdigitated fingers 320B is shown on FIG. 5*c*. The interdigitated fingers 320A have a greater number of outer fingers 322A and inner fingers 324A separated by break 326A. Via 328A connects the inner fingers 324A with the layer of conductive material 314A on the bottom side of the main loop PCB 310A. Once again, the fingers are trimmed by cutting away the copper using a laser and trimming the inner fingers 324A produces a greater change in the capacitance of the main loop PCB 310A than trimming the outer fingers 322A.

FIG. 5*c* shows the main loop PCB 310A with at least one laser cut slot 318 in the conductive material 314A. The laser cut slots 318 adjust the inductance L of the main loop PCB 310A since the inductance of a conductor is dependent on the length, width, and thickness of the conductor. In this way, the resonant frequency of the main loop PCB 310A can be adjusted by trimming away conductive material 314A of the main loop PCB by providing the laser cut slots 318 of varying thicknesses and lengths. Even though trimming away the conductive material 314A provides a means for changing the inductance L of the main loop PCB 310A, trimming the conductive material also increases the loss and decreases the efficiency of the main loop PCB.

Figure 5E:
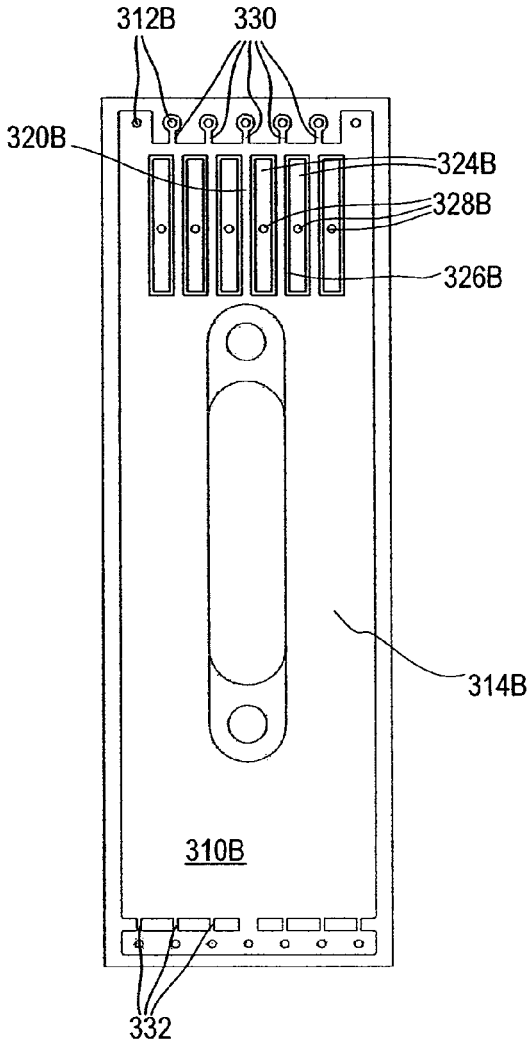
FIGS. 5*e* and 5*f* show a top and bottom view, respectively, of a third embodiment of the main loop printed circuit board.
Figure 5F:
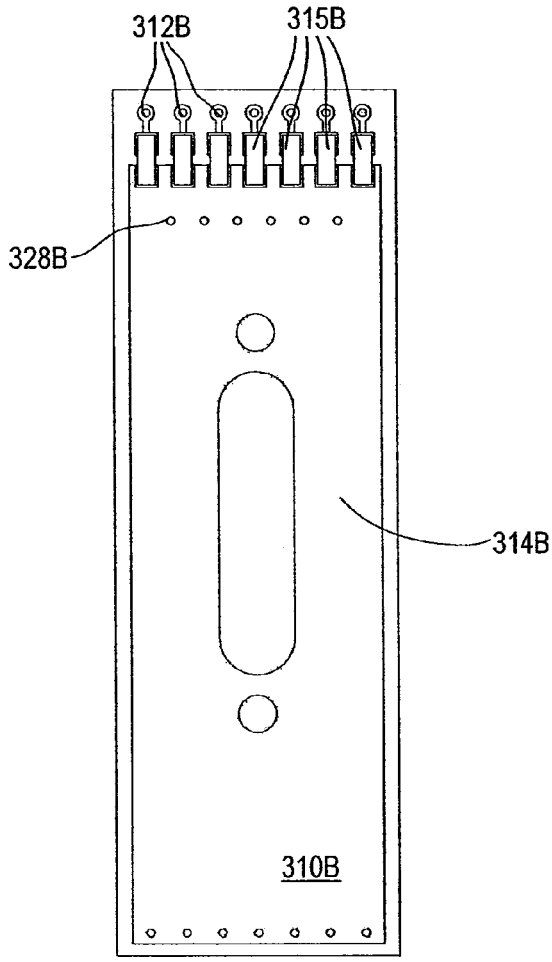

FIGS. 5*e* and 5*f* show the top view and bottom view, respectively, of a third possible embodiment of the main loop PCB 310B, showing further means for changing the inductance L and capacitance C of the main loop PCB 310B. Capacitive fingers 320B provide means for trimming the capacitance of the main loop PCB 310B. Inner fingers 324B are separated from the conductive material 314B on the top side of the main loop PCB 310B by breaks 326B and are connected to the conductive material 314B on the bottom side of the main loop PCB 310B by vias 328B. The inner fingers 324B are trimmed by cutting away the copper using a laser.

On the bottom side of main loop PCB 310B, seven surface mount capacitors 315B are shown, each connected to a separate via 312B as shown in FIG. 5*f*. On the top side, each of the five inner vias 312B are connected to the conductive material 314B by traces 330. By cutting one or more of the traces 330 with a laser, the capacitance of the main loop PCB 310B is changed by simply removing the capacitor 315A attached to the trace 330 from the circuit.

Traces 332 on the top side of main loop PCB 310B provide a means for trimming the inductance of the main loop PCB. When these traces are cut, the inductance L of the main loop PCB 310B changes since the inductance of a conductor is dependent on the length, width, and thickness of the conductor.

Figure 6:
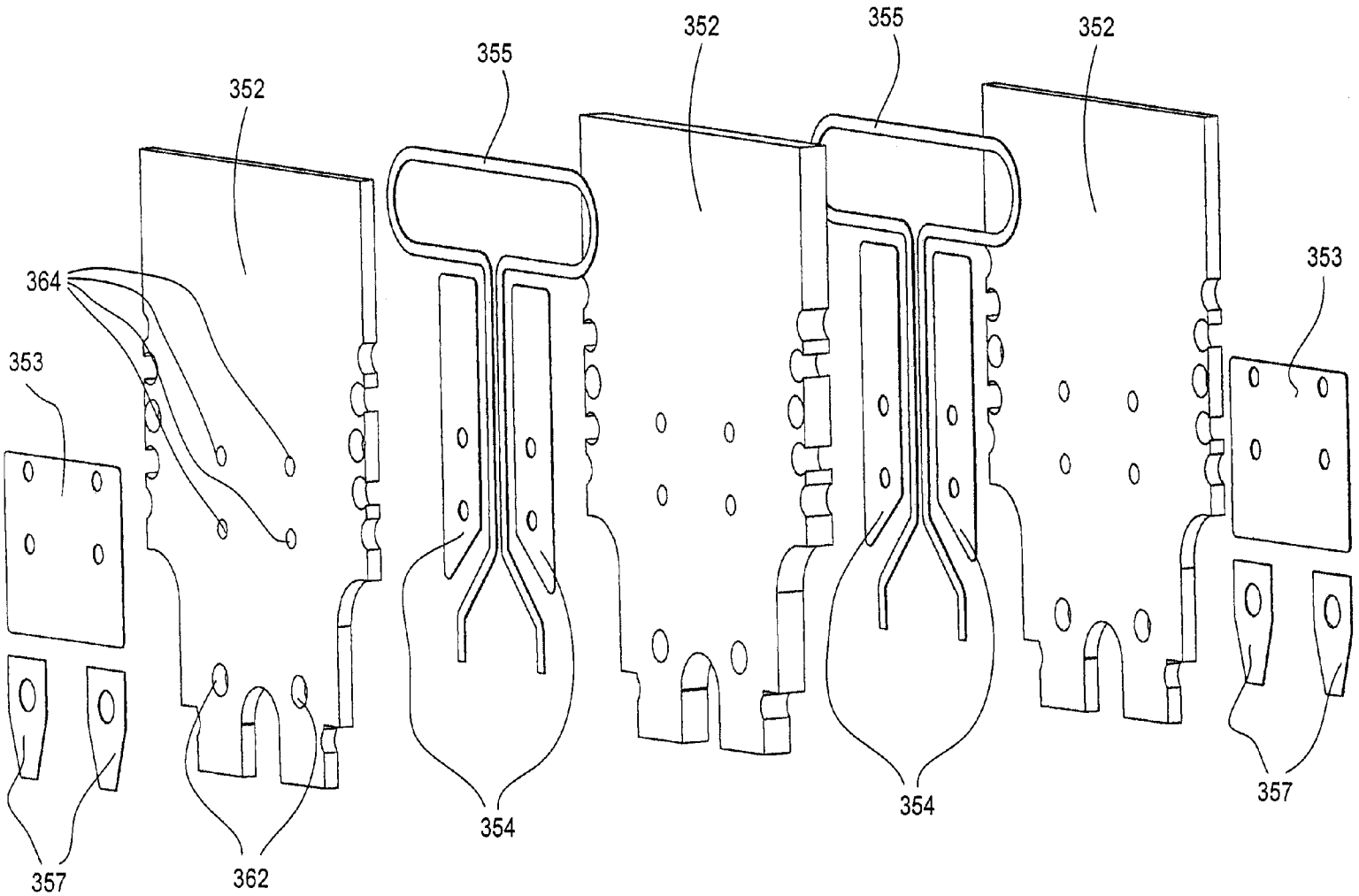
FIG. 6 shows an exploded view of the feed loop printed circuit board.

FIG. 6 shows an exploded view of the feed loop printed circuit board 350 also shown in FIG. 4. Three layers of insulation 352, made from FR-4 printed circuit board substrate, are located between four layers of a suitable conductive material (e.g., copper, aluminum, steel). The two inner layers of conductive material include feed loop traces 355, which are coupled in parallel and are insulated from external contact with the main loop PCB 310 and yoke 518 by the outer insulating layers 352. The feed loop traces 355 are connected to the two ends 357 through vias 362 and are surrounded by inner shielding 354 and outer shielding 353, which both may be copper, aluminum or steel or any suitable metal and acts to shield the circuitry of the lighting control device from RF interference. The outer shielding 353 and inner shielding 354 are connected by vias 364.

Figure 7:
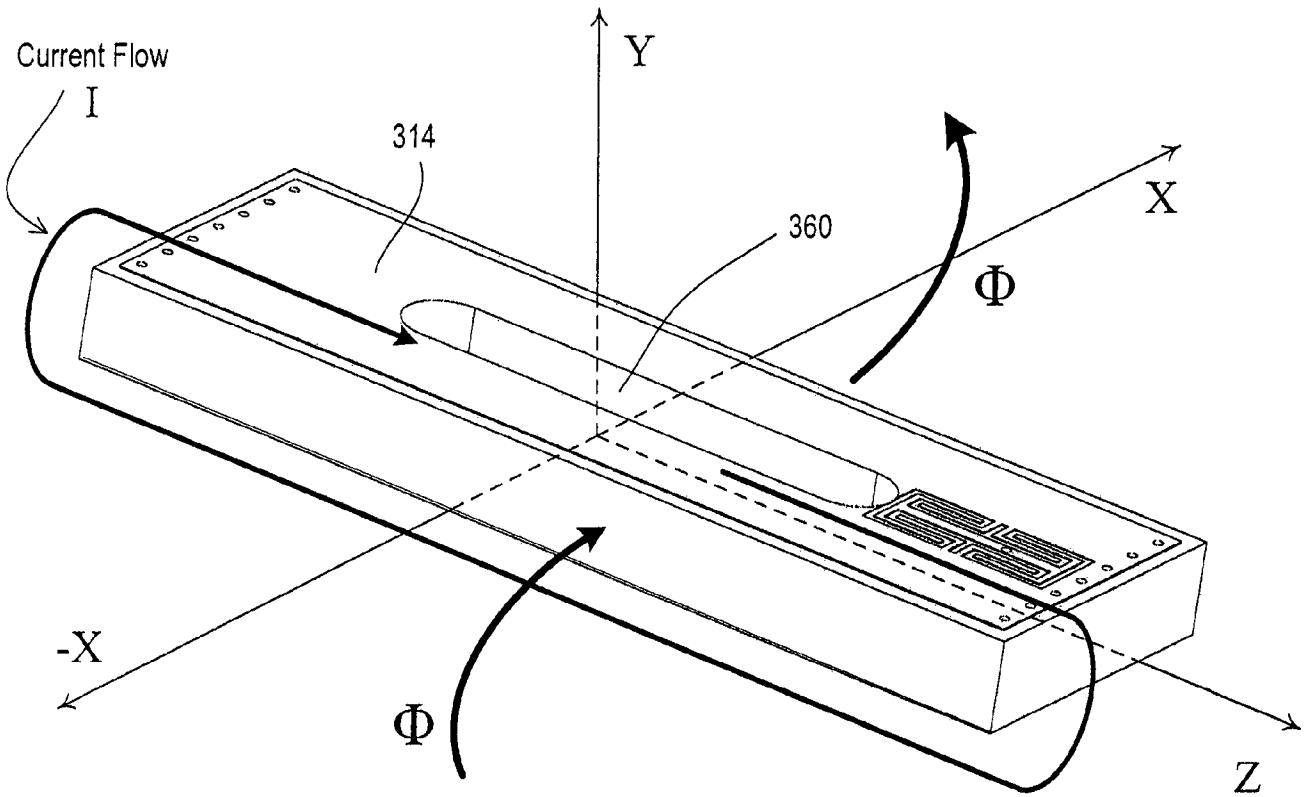
FIG. 7 schematically shows the electrical and magnetic characteristics of the resonant loop antenna of the present invention.

FIG. 7 schematically shows the electrical and magnetic characteristics of the resonant loop antenna of the present invention. The main loop PCB 310 has a main loop axis, which is parallel to the Z-axis. As shown, RF signals received by the main loop PCB 310 induce a current flow I through the upper and lower surfaces of the main loop PCB. Current flows through the vias 312 at each end and is at a maximum magnitude when the RF signal being transmitted or received is at the resonant frequency determined by the inductance L and capacitance C of the main loop 210. The current flow induces a magnetic field Φ as shown. The magnetic lines of flux intersect the feed loop 250, causing a current to be induced in the feed loop for input to the receiver of the RF circuit. When transmitting, RF signals in the feed loop PCB 350 are electromagnetically coupled to the main loop PCB 310 by the magnetic field Φ, establishing a current flow in the main PCB 310 at the resonant frequency for transmission as radio frequency signals.

The antenna 300 provides a substantially isotropic radiation pattern, meaning that the antenna radiates relatively uniformly in all directions over a sphere centered on the antenna. There are no locations on the sphere in any direction where the radiated power equals zero. This means that the antenna 300 can be mounted in any fashion, i.e. horizontally or vertically, and still perform suitably.

Figure 8:
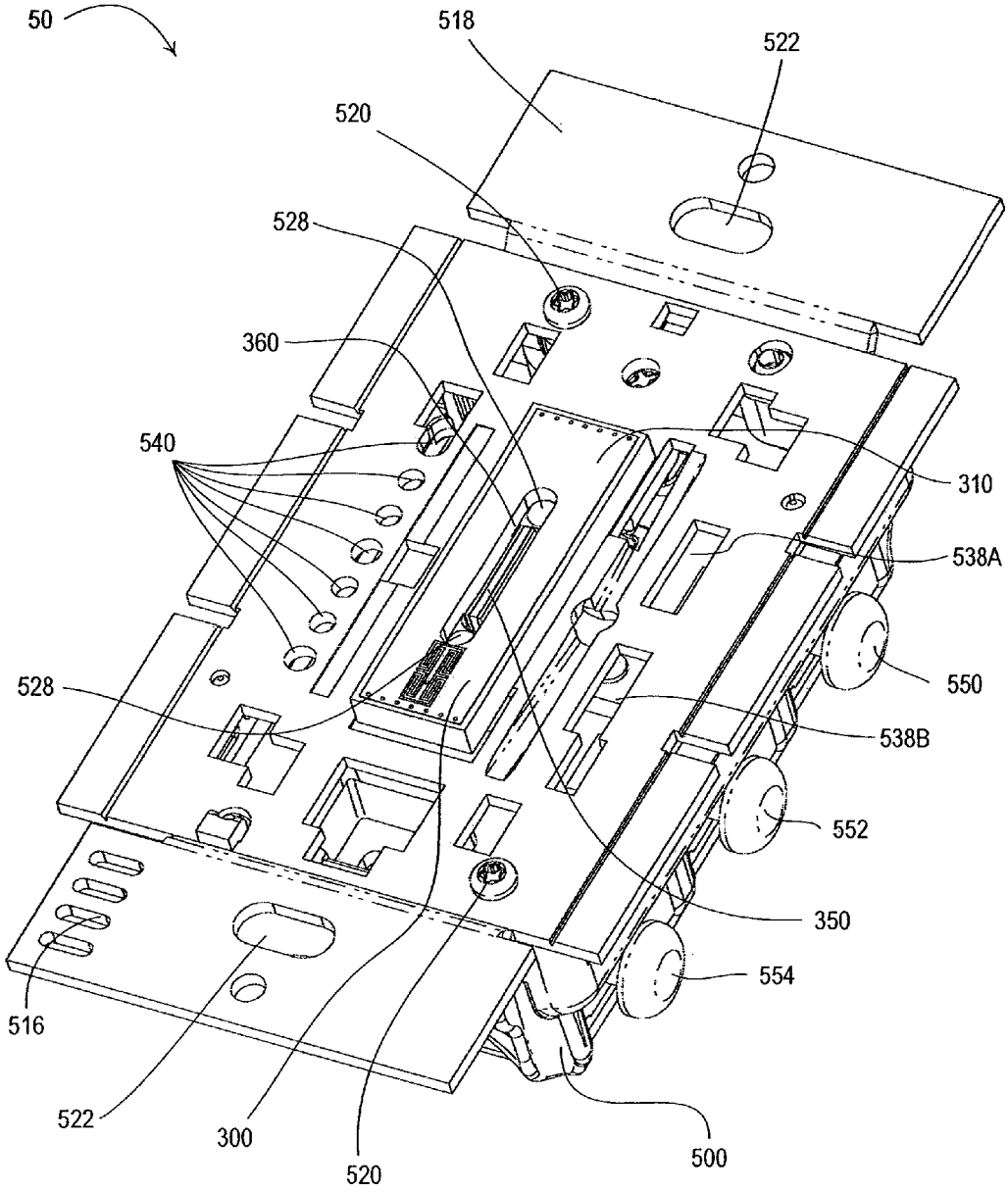
FIG. 8 shows a perspective view of a light dimmer according to the present invention incorporating a first embodiment of the antenna of the present invention.
Figure 10:
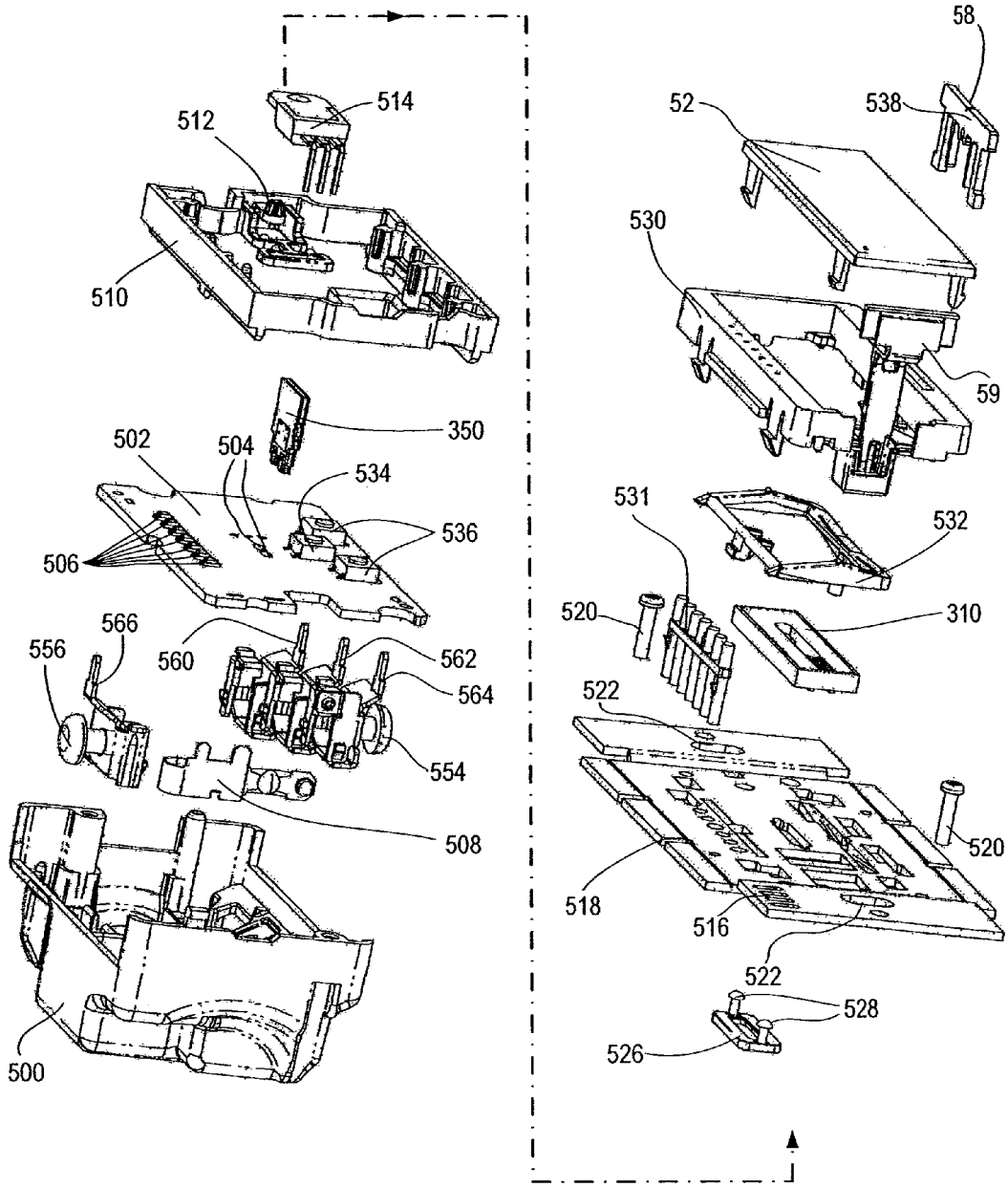
FIG. 10 is an exploded perspective view of a dimmer incorporating the antenna of the present invention.

FIG. 8 is a perspective view of a dimmer lighting control device 50 incorporating the antenna 300 according to the present invention. The faceplate, as well as the actuating switch mechanisms 52 and 58 for controlling the on/off operation and lighting intensity of the lamp, is not shown in FIG. 8. These mechanisms would be disposed on top of the dimmer assembly shown in FIG. 8. These mechanisms have purposely not been shown in FIG. 8 so as to reveal the structure of the antenna according to the present invention. However, FIG. 10 shows details of the on/off and dimming actuating mechanisms.

With reference to FIG. 8, a perspective view of a light dimmer 50 incorporating the antenna of the present invention is shown. The light dimmer 50 includes a housing including a back cover cap 500. The housing houses the electronic circuitry of the light dimmer including power/dimming circuitry, control electronics and RF circuitry. A screw terminal 554 is included on the back cover 500 for connection of AC hot from the electrical power system 10 to the dimmer 50. Another screw terminal 550 allows for connection of dimmed hot to the load 54. A screw terminal 552 connects to neutral (if required). A fourth screw terminal 556 (shown in FIG. 6) allows for connection of an accessory control link.

The dimmer includes a yoke 518 which is typically made of metal, e.g., steel or aluminum, and is adapted to enable the light dimmer to be secured in an electrical wall box in conventional fashion using screws through holes 522. The yoke 518 is preferably made of metal to provide a heat sink for the power dissipating components of the dimmer. The yoke 518 includes a number of apertures therethrough to be described in greater detail with reference to FIG. 10, which allow actuation of the dimmer controls, i.e., the on/off function as well as setting the dimming levels. For example, apertures 538A and 538B allow entry of projections from a dimmer rocker mechanism to actuate a dimmer setting switch disposed in the interior of the dimmer 50. In addition, apertures 540 are provided to allow the illumination from light emitting diodes (LEDs), which display the intensity level of the lamp attached to the control, to shine through the yoke 518. The metal yoke 518 is preferably coupled to earth ground through a wire that is connected to ground connection means 516.

In the center of the yoke 518, the antenna of the invention 300, is provided. According to the embodiment shown in FIG. 8, the antenna of the invention comprises the main loop PCB 310 and the feed loop PCB 350 disposed substantially perpendicularly to the main loop PCB 310 and in a slot 360 of the main loop PCB. The main loop axis of the main loop PCB 310 is parallel to the plane of the yoke 518. Since the metal yoke 518 of the dimmer 50 is preferably grounded, the main loop 310 must be mounted on the outer surface of the yoke 518. The feed loop printed circuit board is isolated from the main loop and coupled to it substantially only magnetically. The main loop printed circuit board 310 may be held to the yoke by a heat stake having posts 528, which attach the main loop to the yoke at areas of minimal current density as explained above. There is an aperture in the yoke 518 at the location where the capacitors 315 are mounted on the bottom side of the main loop PCB 310 when the main loop PCB is attached to the yoke to prevent contact with the capacitors and the yoke.

Figure 9:
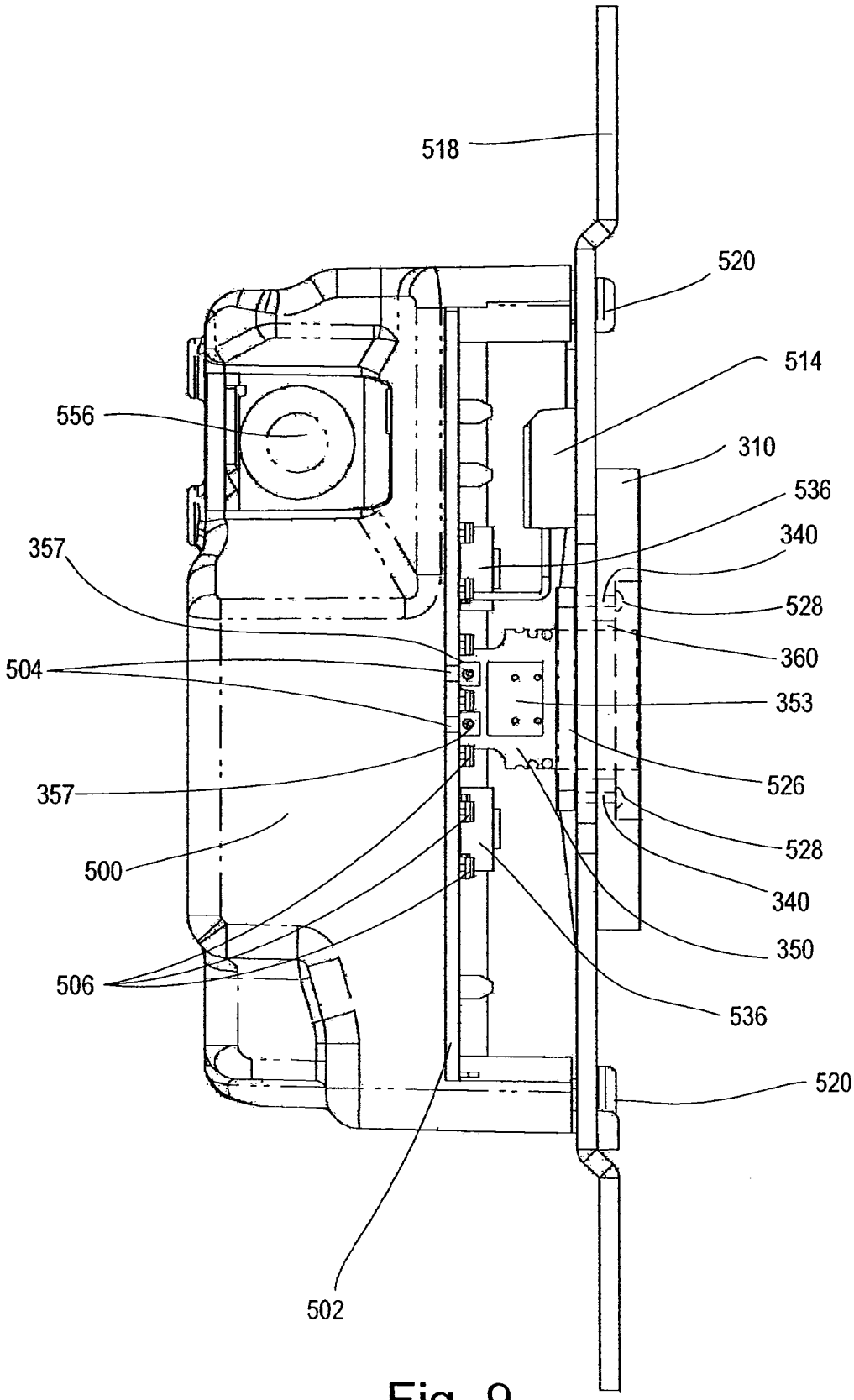
FIG. 9 shows a cross sectional view of a lighting control device comprising a dimmer incorporating the antenna of the present invention.

FIG. 9 shows a side cross sectional view of the dimmer 50, without the faceplate, dimmer and on/off controls. The main loop PCB 310 is attached to the yoke 518 by heat stake 526, which is an insulating fastener that does not change the magnetic characteristics of the main loop PCB. As explained above, the heat stake 526 is made from a thermoplastic material and comprises two straight posts 528 that fit through apertures 340 in the main loop PCB 310. The ends of the posts 528 are formed by the use a horn, which is heated in order to melt the thermoplastic material. After the heat staking process, the ends of the posts 528 have a diameter greater than the diameter of the apertures 340, thus holding the main loop PCB 310 in place. The ends 357 of feed loop PCB 350 are connected to slots 504 on the dimmer circuit PCB 502. The feed loop PCB 350 is mounted perpendicular to the main loop PCB 310 and in the slot 360 in the main loop PCB. The feed loop PCB 350 is electrically coupled to the RF portion of the dimmer circuit board 502 via the ends 357. Note that when feed loop PCB 350 is installed in the dimmer 50, the outer shielding material 353 is below the plane of the yoke 518.

FIG. 10 shows details of the construction of the lighting control device 50 incorporating the antenna according to the present invention. FIG. 10 is an exploded view of the lighting control device 50 of FIGS. 8 and 9. The lighting control device 50 includes an insulating back cover cap 500 having screw terminals 550, 552, 554, 556 to which the electrical wires can be provided for Dimmed Hot, Neutral, Hot, and accessory control, respectively. Into the back cover cap 500, a dimmer printed circuit board 502 is provided coupled to the antenna 300 already described. The feed loop PCB 350 connects to slots 504 in the dimmer PCB 502. The purpose of the dimmer PCB 502 is to receive radio frequency signals from the antenna 300 for controlling the operation of the lamp as well as for feeding radio frequency signals to the antenna 300 for transmission back to the master devices. The dimmer PCB 502 also includes a suitable power supply 116 and a microprocessor control circuit 108 that is controlled by signals received from the antenna 300 and which transmits signals to the antenna 300 concerning the status of the controlled lamp. The dimmer PCB 502 also includes a plurality of light emitting diodes (LEDs) 506, which indicate the status of the affected lamp. A light pipe assembly 531 is provided above yoke 518 and couples the light from each of the light emitting diodes 506 externally of the device to display the dimming status of the controlled lamp.

Coupled to the back cover cap 500 is a back cover ring 510 also made of an insulating material. The intensity of the lamp controlled by the dimmer printed circuit board 502 is controlled by a semiconductor power device 514, which may comprise a triac. Power semiconductor device 514 is held in place by post 512 of back cover ring 510, such that the power semiconductor device 514 is in contact with the metal yoke 518 to dissipate heat. The yoke 518 thus comprises a heat sink and also functions as the means by which the lighting control device 50 is mounted into an electrical wall box. Accordingly, yoke 518 includes two screw holes 522 receiving mounting screws for mounting the yoke and accordingly, the device 50 into the electrical wall box in conventional fashion. The main loop PCB 310 is fastened to the yoke 518 near the center of the yoke by heat stake 526 having posts 528. The feed loop printed circuit board 350 of the antenna 300 is coupled to the dimmer PCB 502.

Disposed above the yoke 518 is an actuating button 52 operating through the intermediary of a hinge bar 532 to control a switch 534 on dimmer PCB 502. The switch 534 is operated by the hinge bar 532 and provides signals to the control circuit 108, which controls the operation of the power semiconductor device 514 to control the on/off status of the dimmer 50. In addition, a rocker arm control 538 is provided having operating surfaces 58 for increasing and decreasing the intensity level of the connected lamp by contacting switches 536 on the dimmer PCB 502. An air gap actuator 59 operates an air gap switch to provide a positive air gap system-off for system maintenance. Bezel 530 is provided as an outer covering for aesthetic purposes and may be suitably colored. Preferably bezel 530 and members 52, 59 and 538 are each factory installed in one of selected colors so that an appropriate aesthetic appearance can be obtained. These respective components are interchangeable so that different colors or color combinations can be provided.

In contrast to the prior art antenna shown in U.S. Pat. Nos. 5,982,103 and 5,736,965, the entire disclosures of which are incorporated by reference herein, because the main loop printed circuit board 310 is electrically isolated from the feed loop printed circuit board, the amount of insulation necessary between the user actuatable and contactable surfaces 52, 58, 59, 530 and the face plate of the lighting control device and the AC-connected portions of the lighting control device is reduced. In particular, the main loop printed circuit board 310 is completely isolated from the feed loop printed circuit board 350. The main loop printed circuit board 310 is preferably electrically connected to the yoke 518, but it may be insulated from the yoke 518 with a small insulating member between the printed circuit board and the yoke.

The feed loop printed circuit board 350 is electrically connected to the power lines 10 and thus may be at line voltage potential. However, because of the isolation provided by the magnetic coupling between the feed and main loops, the main loop printed circuit board 310 is not at line voltage potential. If the main loop is connected to the yoke 518, it will thus be connected to earth ground via the ground network of the electrical system 10.

In addition to the above benefit, the antenna of the present invention is much smaller than the planar antenna shown in the prior art patents, occupying only a small portion at the center of the yoke 518.

Figure 11:
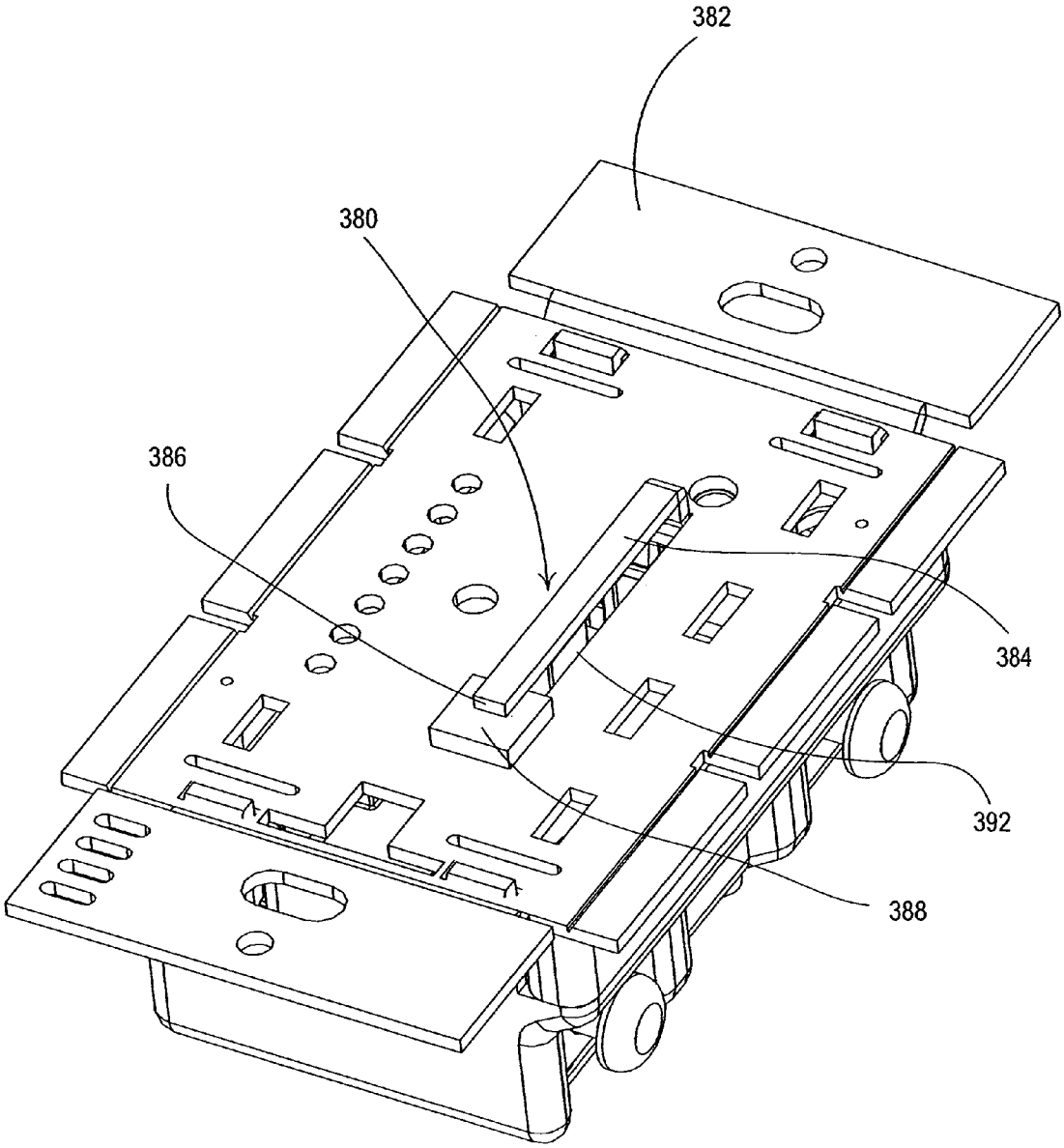
FIG. 11 shows another embodiment of the antenna according to the present invention in which the main loop is formed in part by a metal part stamped from or fastened to the yoke of the electrical control device.

FIG. 11 shows another embodiment of the antenna according to the present invention for use in an electrical control device. FIG. 11 shows the yoke 382 of the electrical control device. The antenna 380 comprises a lance 384, which is stamped out of the metal plate of the yoke 382. Alternatively, the lance 384 could be fastened with screws, rivets or other fasteners or fastening means (e.g. welding) to the yoke 382. The lance 384 is disposed a predefined distance above the plane of the yoke 382 and is separated from the yoke 382 by this distance. At the end 386 of the lance 384, the lance tip 386 is separated from the yoke 382 by a dielectric member 388, which acts as a capacitance between the end 386 of lance 384 and the yoke 382. Accordingly, the lance 384 acts as a radiating and/or receiving member of the antenna 380. Therefore, when acting as a receiver, currents are induced in the loop comprising the lance 384, the dielectric member 388 and the portions of the yoke 382 below the lance 384 and adjacent it. Accordingly, a current loop is formed having a main loop axis substantially parallel to the plane of the yoke 382.

Figure 12:
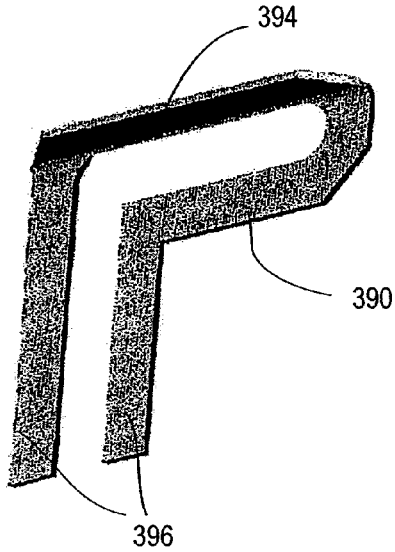
FIG. 12 shows the feed loop of the antenna of FIG. 11.

FIG. 12 shows one embodiment of a feed loop 390, which can be used with the lance 384. It is disposed through an opening 392 formed below the lance 384. In particular, it would be disposed through the opening 392 that is created when the lance 384 is stamped out of the yoke 382. Alternatively, if the lance is secured to the yoke by fasteners or welded or otherwise fastened to the yoke, an opening 392 is formed below the lance 384 sized to receive the feed loop 390. The feed loop 390 can also be disposed on a printed circuit board or on some other substrate and may have insulation thereon as in the previously described embodiments to electrically isolate it from the yoke and the main loop. The feed loop 390 has two ends 396 for connection to the RF control circuitry.

Figure 13:
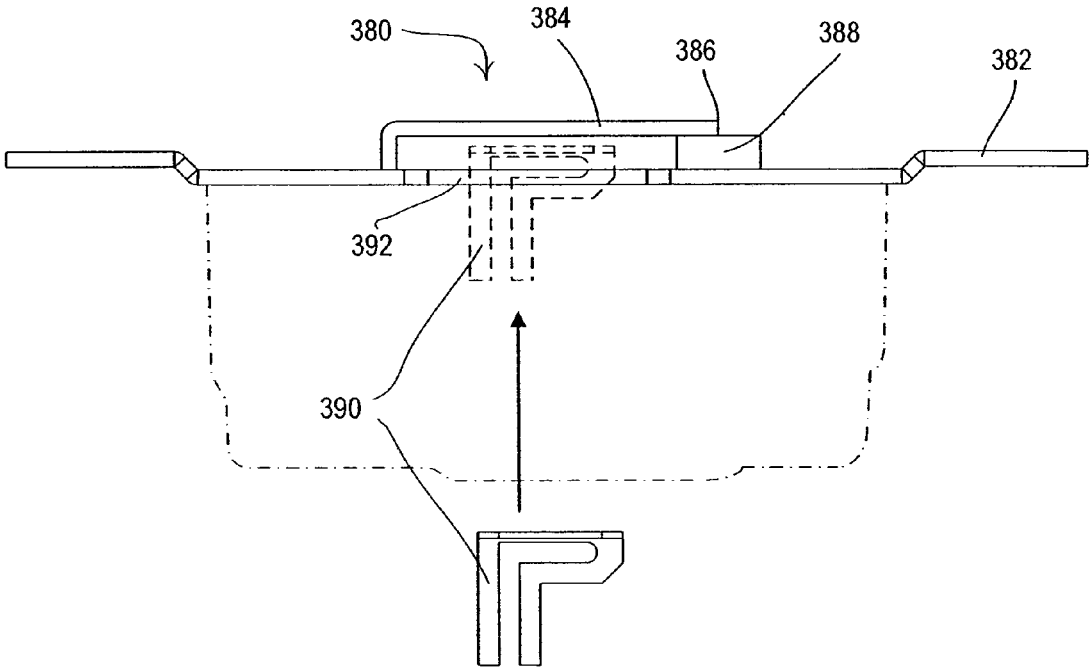
FIG. 13 shows a side view of the antenna of FIG. 11.

FIG. 13 provides a side view of the antenna 380 showing how the feed loop 390 fits into the opening 392 in the yoke 382 under the lance 384.

The dielectric member 388 may be made from suitable material. One suitable material is Rodgers 4010 or 3010 material and it can be laser trimmed. A suitable clamping means may be provided to clamp the lance end 386 to the dielectric member 388 to prevent inadvertent changes in the capacitance.

Alternatively, the lance 384 can be coupled to the yoke at both ends by a dielectric member 388, effectively distributing the capacitance between the two ends of the lance 384.

Any other suitable dielectric material can be chosen for the dielectric member 388. It is preferable that a low loss material be used. Losses in the resonating capacitor will directly detract from the efficiency of the loop.

Another source of possible losses in the loop/capacitor combination is in the dissimilar metals forming the yoke-to-capacitor junctions. If the yoke is formed of aluminum, the aluminum should be abraded prior to making the pressure contact and means to ensure continued pressure and additional oxidation prevention should be used. The PCB forming the capacitor should preferably be tinned, since a tin/lead aluminum junction has a lower potential for corrosion than an aluminum-copper junction. Plating selected areas (or "spot plating") of the yoke may also be possible.

In an embodiment of the antenna 380, the top of the lance 384 of the main loop is 0.125 inch above the surface of the yoke. The lance is 0.045 inch thick and 0.120 inch wide. The loop is 2.18 inches long. The loop can be made longer. The efficiency improves as the loop is made longer and thus the enclosed area larger.

The efficiency of the antenna 380 is directly related to the area enclosed by the loop. The height of the lance 384 above the yoke 382 is thus the most sensitive parameter for efficiency. This height is directly limited by the thickness of the plastic face of the dimmer. To provide maximum benefit, the antenna 380 should extend as far as possible towards the faceplate of the lighting control device.

Preferably, the feed loop 390 shown in FIG. 12 is inserted into the slot 392 in the yoke 382 below the lance 384. The feed loop 390 could be encapsulated in plastic to provide the voltage isolation required.

The feed loop 390 may be made from flat metal stock, for example, 0.015 inch brass. The top of the loop is preferably folded over which enables close magnetic coupling with the main loop, limited by the thickness of the insulation between them as required by the dielectric breakdown requirements. This is shown in FIG. 12 by the fold-over 394. The plastic housing of the feed loop may anchor the main loop lance 384 setting the antenna height and providing protection from damage.

Since the coupling between the main loop and the feed loop is substantially via the magnetic field, the dielectric constant of the plastic material encapsulating the feed loop is relatively insignificant.

There has thus been described a resonant loop antenna as well as an electrical control device incorporating a loop antenna wherein the loop antenna has a main loop radiating receiving part which is primarily magnetically coupled to a feed loop.

Further, the radiating and receiving main loop is isolated from the feed loop because of the inductive coupling and thus does not require any additional isolation means to prevent the danger of electrical shock. A desired feature of a dimmer is the ability to replace the entire user interface assembly (faceplate, button, bezel, rocker arm, etc.) with a user interface having a different color in the field, the dimmer cannot be potentially harmful when the user interface is removed and the yoke and antenna are exposed to the user. This means that there must be suitable electrical isolation between the high voltage circuitry on the dimmer PCB 502 and any surface that the user can touch to prevent electrical shock.

Furthermore, the antenna is easily tunable over a wide range because it can be tuned by adjusting only one element, either the inductance or capacitance while maintaining the characteristic impedance at a given value. Adjusting the capacitance is generally preferable since adjusting the inductance may increase the losses in the main loop.

Furthermore, the primary and leakage inductances are weakly coupled. The antenna comprises a series resonant antenna and can be tuned separately from the drive circuit. Furthermore, the antenna is field changeable so that the frequency of operation can be changed easily. The feed loop can be shielded to minimize noise and it can be surrounded by insulating materials to obtain further isolation. Furthermore, the antenna provides advantages over the prior art compact antennas in electrical control devices because the transmission range is extended, and is more easily tunable.

Furthermore, the antenna of the invention is less expensive to manufacture than the antennas of the prior art.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. An electrical control device for controlling an amount of power delivered from an AC power source to a controlled electrical device, the AC power source generating a line voltage at a line voltage potential, the electrical control device comprising:

a power conducting semiconductor device for controlling the amount of power delivered to the controlled electrical device;

a control circuit;

a transmitter and/or receiver in communication with the control circuit; and an antenna coupled to the transmitter and/or receiver; the antenna adapted to receive a first signal at a specified frequency from a remote control device and/or transmit a second signal at a specified frequency to a remote control device;

wherein the transmitter and/or receiver is operable to couple the first signal from the antenna to said control circuit for remotely controlling said controllably conductive device and/or couple the second signal from said control circuit to said antenna for providing a status of said controlled electrical device, the antenna comprising:

a first radiating loop of conductive material having a capacitance and an inductance; the capacitance and the inductance forming a circuit being resonant at the specified frequency;

a second feed loop of conductive material having two ends adapted to be electrically coupled to the transmitter and/or receiver, the second feed loop being substantially only magnetically coupled to said first radiating loop;

said first radiating loop and second types feed loop each having a loop axis, the loop axes of the first radiating loop and second types feed loop being substantially parallel or coincident;

wherein the first radiating loop is electrically conductively isolated from the line voltage of the AC power source.

2. The device of claim 1, wherein the first radiating loop of conductive material comprises a break and the capacitance includes a capacitor bridging the break.

3. The device of claim 1, further comprising:

an actuator coupled to the control circuit; said control circuit responsive to the actuator.

4. The device of claim 1, wherein the first radiating loop is electrically isolated from the second feed loop.

5. The device of claim 1, wherein the second feed loop is substantially at line voltage potential.

6. The device of claim 1, further comprising:

a status indicator for indicating the status of the controlled electrical device; the status indicator coupled to and responsive to the control.

7. The device of claim 1, further comprising:

a housing for the power conducting semiconductor device, the control circuit, the transmitter and/or receiver, and the antenna; and a support yoke coupled to the housing for fastening the electrical control device to an electrical wall box.

8. The device of claim 7, wherein said yoke comprises a metal plate substantially coextensive with said housing and having mounting ears extending therefrom for fastening the yoke to the electrical wall box, said antenna being disposed on an outwardly facing surface of said yoke.

9. The device of claim 8, wherein said yoke includes an opening therein for said second feed loop.

10. The device of claim 7, wherein the antenna is disposed approximately in the center of the yoke.

11. The device of claim 7, wherein the first radiating loop and second feed loop comprise printed circuit boards, the first radiating loop being disposed on a printed circuit board disposed parallel to the plane of the yoke, and the second feed loop is disposed on a printed circuit board disposed perpendicular to the printed circuit board containing the first radiating loop.

12. The device of claim 7, wherein the first radiating loop is formed in part from a first conductive member disposed at a defined distance from the yoke parallel to a plane of the yoke, with the break formed between a portion of the first conductive member and the yoke.

13. The device of claim 1, further comprising a manual actuator for controlling the power conducting semiconductor device.

14. The device of claim 1, wherein said controlled electrical device comprises an electrical lamp and said control circuit further comprises a dimmer circuit for controlling the intensity of said lamp.

* * * * *